US007856690B2

(12) United States Patent
Tuman et al.

(10) Patent No.: US 7,856,690 B2
(45) Date of Patent: Dec. 28, 2010

(54) BRUSHING ASSEMBLY

(75) Inventors: Scott J. Tuman, Woodbury, MN (US); Eric B. Laughlin, Minneapolis, MN (US); Aaron J. Cherveny, Minneapolis, MN (US); Byron E. Trotter, St. Paul, MN (US); Lloyd S. Vasilakes, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 961 days.

(21) Appl. No.: 11/562,448

(22) Filed: Nov. 22, 2006

(65) Prior Publication Data

US 2008/0115803 A1 May 22, 2008

(51) Int. Cl.

| | |
|---|---|
| ***A47L 25/00*** | (2006.01) |
| ***A46B 15/00*** | (2006.01) |
| ***B08B 1/00*** | (2006.01) |
| ***B08B 1/04*** | (2006.01) |
| ***B08B 7/00*** | (2006.01) |

(52) U.S. Cl. ..... 15/104.002; 134/6

(58) Field of Classification Search ..... 15/104.002, 15/105, 114, 246, 257.01; D4/138; 134/6, 134/10, 42; *A47L 25/00, 25/08*

See application file for complete search history.

(56) References Cited

U.S. PATENT DOCUMENTS

| | | | | |
|---|---|---|---|---|
| 3,089,170 A | | 5/1963 | Buchsbaum | |
| 3,398,418 A | | 8/1968 | Bogner et al. | |
| 3,742,547 A | * | 7/1973 | Sohmer | 15/104.002 |
| 4,959,265 A | | 9/1990 | Wood et al. | |
| D320,680 S | * | 10/1991 | Stetson et al. | D30/158 |
| 5,077,870 A | | 1/1992 | Melbye et al. | |
| 5,479,673 A | * | 1/1996 | Carton | 15/111 |

(Continued)

FOREIGN PATENT DOCUMENTS

| | | |
|---|---|---|
| EP | 1 442 693 | 8/2004 |

(Continued)

OTHER PUBLICATIONS

U.S. Appl. No. 29/244,348 Newbould et al. filed Dec. 8, 2005.

(Continued)

*Primary Examiner*—Monica S Carter
*Assistant Examiner*—Stephanie Newton
(74) *Attorney, Agent, or Firm*—Trisha D. Adamson

(57) ABSTRACT

The present invention provides a brushing assembly and a method of cleaning a surface. In one embodiment, the brushing assembly comprises a lint roller comprising a handle and a roll of adhesive tape supported by a barrel, wherein the adhesive tape has an exposed tacky surface. The brushing assembly further comprises a caddy cover comprising an opening for placement over the barrel and roll of adhesive tape of the lint roller and at least one working surfaces. In one embodiment, the method of cleaning a surface comprises providing a lint roller, providing a caddy cover having at least one working surfaces, placing the caddy cover over the lint roller, brushing the surface to be cleaned with at least one of the working surfaces of the caddy cover to gather debris, removing the caddy cover from the lint roller, and rolling the lint roller over the surface to be cleaned to capture the debris.

19 Claims, 3 Drawing Sheets

U.S. PATENT DOCUMENTS

| | | | | |
|---|---|---|---|---|
| 5,763,038 | A | 6/1998 | Wood | |
| 5,878,457 | A | 3/1999 | Cox et al. | |
| 5,940,921 | A | 8/1999 | Wood et al. | |
| 6,054,091 | A | 4/2000 | Miller et al. | |
| 6,372,323 | B1 | 4/2002 | Kobe et al. | |
| 6,610,382 | B1 | 8/2003 | Kobe et al. | |
| 6,688,464 | B2 * | 2/2004 | Jessen et al. | 206/349 |
| 6,865,765 | B2 | 3/2005 | Aalbers | |
| 6,904,615 | B2 | 6/2005 | Kobe et al. | |
| 6,962,635 | B2 | 11/2005 | Tuman et al. | |
| 6,981,291 | B2 * | 1/2006 | McKay | 15/23 |
| 7,014,906 | B2 | 3/2006 | Tuman et al. | |
| 7,037,457 | B2 | 5/2006 | Seidel et al. | |
| 2003/0171051 | A1 | 9/2003 | Bergsten et al. | |
| 2004/0088813 | A1 | 5/2004 | Cox | |
| 2005/0066464 | A1 | 3/2005 | McKay | |
| 2005/0184099 | A1 | 8/2005 | McKay | |
| 2006/0112507 | A1 * | 6/2006 | McKay | 15/104.002 |
| 2006/0225233 | A1 * | 10/2006 | McKay | 15/104.002 |

FOREIGN PATENT DOCUMENTS

| | | |
|---|---|---|
| WO | WO 02/091901 | 11/2002 |

OTHER PUBLICATIONS

U.S. Appl. No. 11/304,038 Aubourg et al. filed Dec. 15, 2005.
U.S. Appl. No. 11/362,549 Haskett et al. filed Feb. 24, 2006.

* cited by examiner

BRUSHING ASSEMBLY

FIELD

The present invention relates to a brushing assembly. In particular, the present invention relates to a brushing assembly comprised of a lint roller and a removable caddy cover having brushing surfaces.

BACKGROUND

Lint removing devices such as an adhesive lint roller can be used to capture lint, dirt, debris, hair, and other particles on a surface. However, some types of debris, such as pet hair, can be particularly difficult to pick up from surfaces such as cloth and upholstery. Over these types of surfaces the debris can become embedded into the material of the surface. Therefore, an adhesive lint roller may only capture the surface debris and may not capture the debris in the lower layers of the surface. There is a need for a tool that can both gather debris and can capture and retain the gathered debris.

SUMMARY

The present invention provides a brushing assembly for cleaning surfaces. In one embodiment, the brushing assembly comprises a lint roller comprising a handle and a roll of adhesive tape supported by a barrel, wherein the adhesive tape has an exposed tacky surface. The brushing assembly further comprises a caddy cover comprising an opening for placement over the barrel and roll of adhesive tape of the lint roller and at least one working surfaces.

In another embodiment, the brushing assembly comprises a lint roller comprising a handle and a roll of adhesive tape supported by a barrel, wherein the adhesive tape has an exposed tacky surface. The brushing assembly further comprises a caddy cover comprising an opening for placement over the barrel and roll of adhesive tape of the lint roller and a first working surface, second working surface, and a third working surface, wherein each working surface extends along the direction of the barrel.

In another embodiment, a method of cleaning comprises providing a lint roller, providing a caddy cover having at least one working surfaces, placing the caddy cover over the lint roller, brushing the surface to be cleaned with at least one of the working surfaces of the caddy cover to gather debris, removing the caddy cover from the lint roller, and rolling the lint roller over the surface to be cleaned to capture the debris.

Common references numbers are used throughout the figures to identify common features. While the above-identified drawings and figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention. The figures may not be drawn to scale.

DETAILED DESCRIPTION

Figure 1:
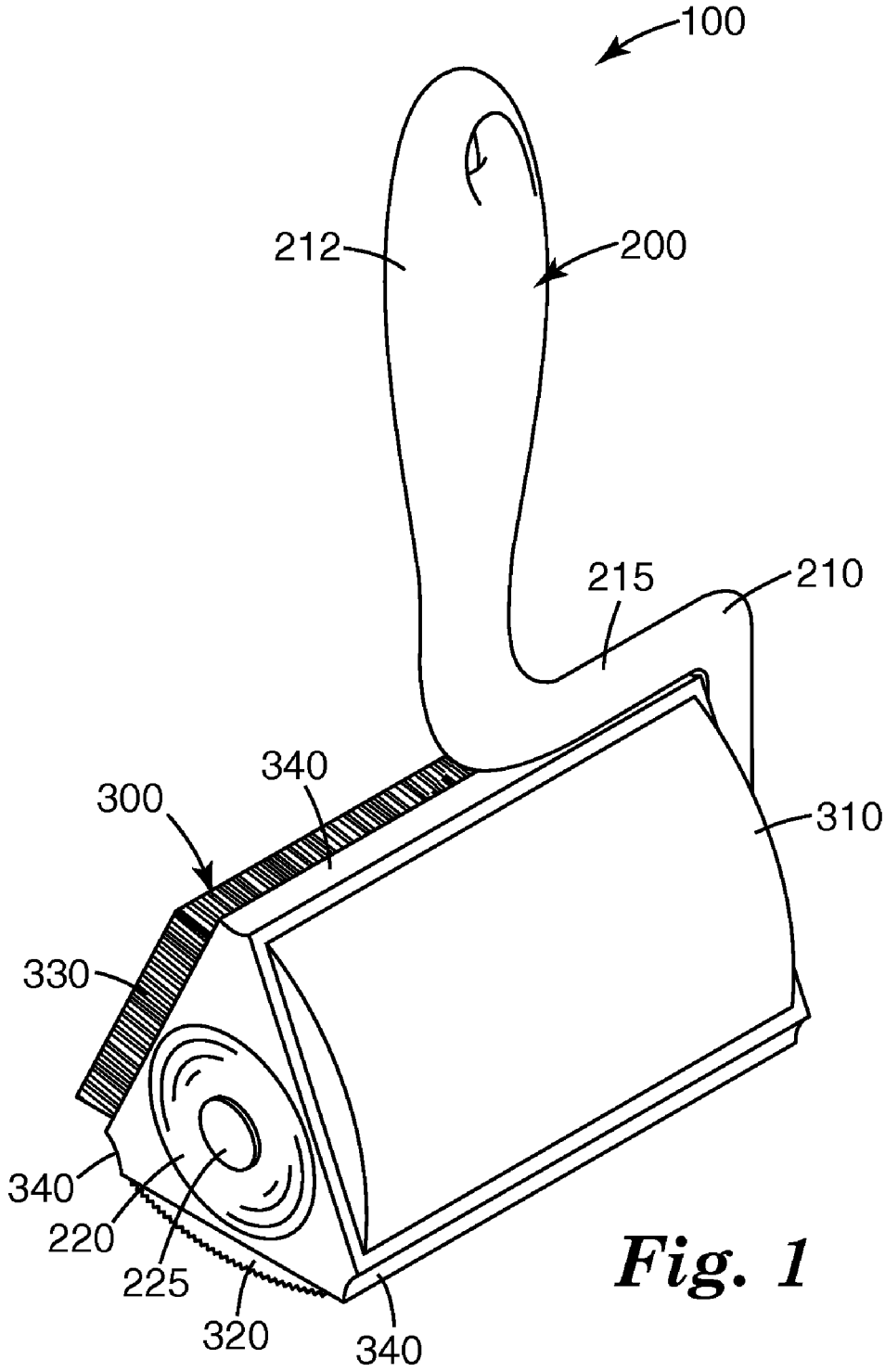
FIG. 1 is a perspective view of an embodiment of a brushing assembly having three working surfaces.
Figure 2:
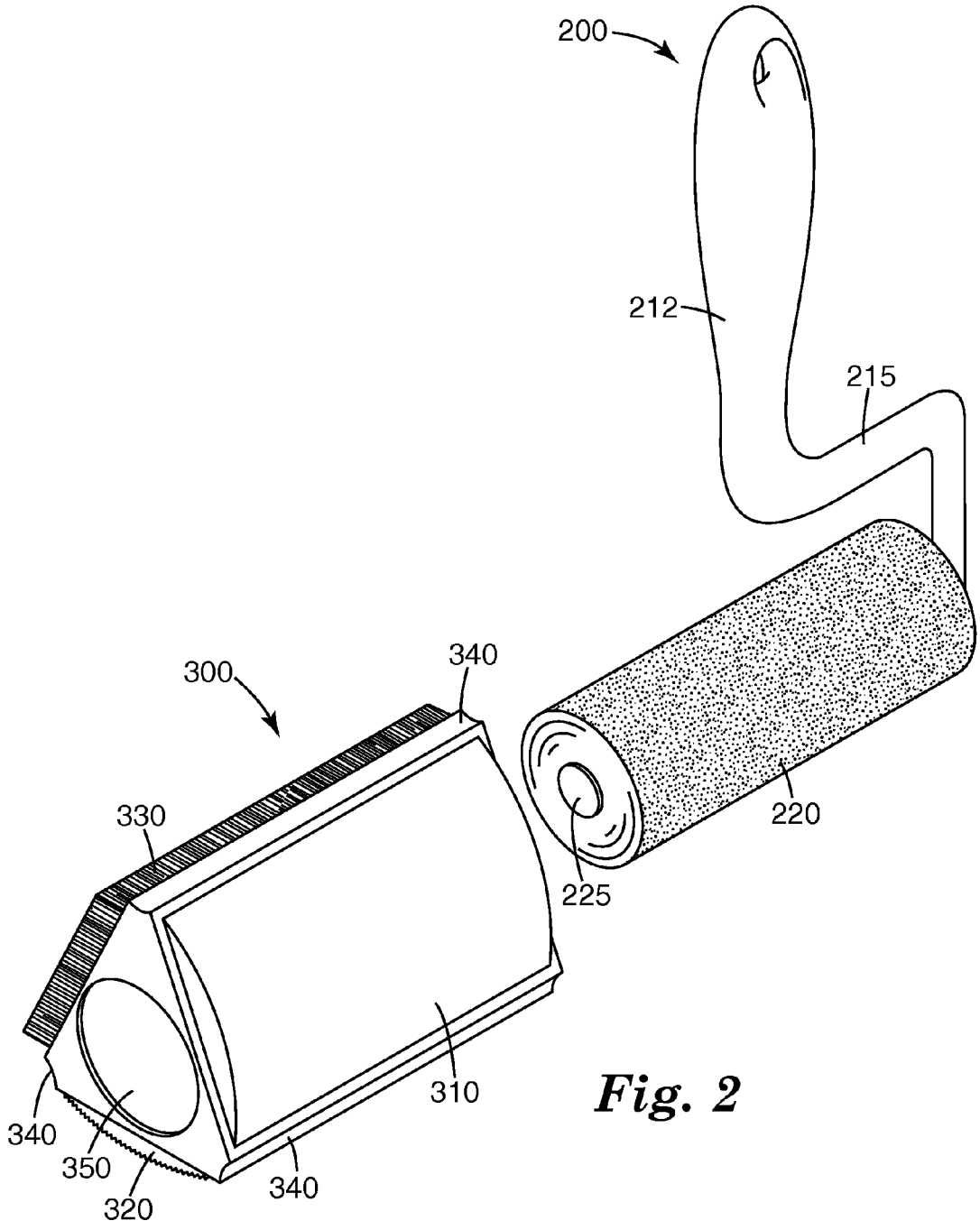
FIG. 2 is an exploded perspective view of the caddy cover and lint roller of FIG. 1.

FIG. 1 is a perspective view of an embodiment of a brushing assembly 100. The brushing assembly 100 includes a lint roller 200 and a caddy cover 300 for placement over the lint roller 200. FIG. 2 is an exploded perspective view of the caddy cover 300 of FIG. 1 removed from the lint roller 200.

The lint roller 200 includes a handle 210 and a roll of tape 220, wherein the tape is rolled such that the adhesive is exposed. The roll of tape 220 is supported on a barrel 225 of the handle 210. The roll of tape 220 freely rotates about the barrel 225.

The handle 210 includes a gripping portion 212 intended to be held by a user's hand and an arm 215 connecting the gripping portion 212 to the barrel 225 of the lint roller 200. The lint roller 200 shown is referred to as a flat surface roller. A flat surface roller is a lint roller where the barrel 225 is perpendicular to the gripping portion 212 of the handle 210. Although a flat surface roller is shown in connection with the caddy cover 300, a linear roller may also be used. A linear roller is a lint roller where the barrel is parallel to the gripping portion of the handle. A suitable flat surface lint roller and linear roller are shown in U.S. Design patent application Ser. No. 29/244,348, filed on Dec. 8, 2005, the disclosure of which is herein incorporated by reference.

The roll of tape 220 may include a core or may be coreless. For use with a coreless roll of tape, the barrel 225 may be constructed such as described in U.S. Pat. Nos. 5,878,457 and 5,940,921, the disclosures of which are herein incorporated by reference. The roll of tape 220 may be formed from a textured surface such as described in U.S. Pat. No. 6,865,765, herein incorporated by reference. Additionally, the strip of tape 220 forming the lint roller may be perforated and in one embodiment may be progressively perforated such as described in U.S. Pat. No. 5,763,038, the disclosure of which is herein incorporated by reference.

The caddy cover 300 includes at least one working surfaces and an opening 350. The opening 350 is for placement over the barrel 225 and roll of tape 220 of the lint roller 200. In the embodiment shown in FIGS. 1 and 2, the caddy cover 300 includes a first working surface 310, a second working surface 320, and a third working surface 330. The working surfaces may be planar or may be curved. In either case, the working surfaces extend along the direction of the barrel 225 of the lint roller 200. As shown, the working surfaces 310, 320, and 330 are planar.

The working surfaces may be constructed from a variety of materials suitable for such activities as cleaning, dusting, lint removal, or brushing. Suitable materials include, but are not limited to, bristles, foam, sponge, nonwoven material, directional fabric, adhesive, recloseable or hook fasteners, and microreplicated film. In one embodiment, at least one of the working surfaces includes a brushing surface. A brushing surface is a surface suitable for gathering embedded material within the surface to be cleaned. Suitable brushing surfaces include, but are not limited to, bristles, foam, sponge, recloseable or hook fasteners, and microreplicated film.

The bristles may be metal or plastic and may be in a variety of lengths, gauges, and densities. Also, flexible rubber bristles may be used. The rubber bristles may have an inherent tackiness that assists in retaining captured debris while the bristles help remove embedded debris from the surface to be cleaned. The bristles may be positioned on the surface anywhere between 0 and 90 degrees. Optionally and additional adhesive coating may be included.

The foam may be an open cell or closed cell foam. One particularly suitable foam is a foamed latex rubber foam. The foam latex rubber is effective at gathering debris. In one embodiment an open cell-foamed latex rubber is used. The open-cell construction provides small pockets that are capable of capturing and retaining debris that are encountered during cleaning. A foamed latex rubber suitable for the foam latex rubber layer is sold under the tradename Gonzo available from Quality Rubber Company, a division of Zephyr Manufacturing of Sedalia, Mo.

The latex rubber material is a material that exhibits a natural tackiness without the need for the addition of a secondary adhesive. This natural tackiness is unique and advantageous in use as a cleaning material. The tackiness assists in picking up and retaining debris. Because a secondary adhesive is not required, the risk of adhesive transfer to the surface being cleaned is eliminated. The latex rubber material may be cleaned using water or other solvents and following cleaning retains a natural tackiness.

The nonwoven material may be a lofty web of fibers and may or may not include an adhesive such as disclosed in US Patent Application Publication 20003-0171051-A1 or in U.S. patent application Ser. No. 11/362,549, filed on Feb. 24, 2006, the disclosures of which are herein incorporated by reference. The nonwoven material may optional include protruding recloseable or hook fasteners or stems. The hook fasteners may be formed on the surface of the nonwoven such as described in U.S. Pat. Nos. 6,962,635 and 7,037,457, the disclosures of which are herein incorporated by reference. Alternatively, the hook fasteners may be imbedded in the nonwoven such as disclosed in U.S. Pat. No. 7,014,906, this disclosure of which is herein incorporated by reference.

Directional fabric includes cut or uncut loops of fibers, such as natural fibers, synthetic fibers, glass fibers, thread, or wool. Preferably, the fibers are nylon fibers. A majority of the fibers are preferably orientated or tilted in one direction. One suitable example of the lint-removing material is commercially available as "De-lint fabric material" from Dalian Corporation based in Dalian, China.

The adhesive comprises an exposed adhesive such as an adhesive lint sheet or a stack of adhesive lint sheets similar to the stack disclosed in U.S. patent application Ser. No. 11/304,038 filed on Dec. 15, 2005, the disclosure of which is herein incorporated by reference. Also, the adhesive may be capable of being wetted and washed.

Hook fasteners or stems are fasteners typically used with other mating hook fasteners or loop materials to connect two surfaces. These include materials such as Velcro® fasteners. For use on a working surface, only one portion of the fastening system would be included. An example of a stem is shown in U.S. Pat. Nos. 5,077,870 and 6,054,091, the disclosures of which are herein incorporated by reference.

A microreplicated film is a replicated film with upstanding protrusions, such as shown and described in U.S. Pat. Nos. 6,372,323; 6,610,382; and 6,907,615, the disclosures of which are herein incorporated by reference. A variety of microreplicated films may be used wherein the protrusions on the film have a variety of lengths, shapes, thicknesses, flexibility, and density. The protrusions on the microreplicated film may be in a uniform pattern or may be in a random repeating pattern. The protrusions may extend across the entire surface or may be present on only a portion of the surface. Optionally, the microreplicated film may include an adhesive such as disclosed in U.S. Pat. No. 4,959,265, the disclosure of which is herein incorporated by reference.

To prevent the caddy cover 300 from rotating during use, a locking mechanism may be included. In one embodiment, the locking mechanism includes a retaining passage 340 on the caddy cover 300. The retaining passage 340 is recessed enough to allow the caddy cover 300 to be placed over the lint roller 200 and to have the arm 215 contact the retaining passage 340 to prevent rotation of the caddy cover 300. As shown, the retaining passage 340 is a recessed groove in the caddy cover 300. The recessed groove may be in any shape, but is shown as a curved groove. The arm 215 of the handle 210 of the lint roller 200 engages with the retaining passage 340 to prevent rotation of the caddy cover 300. As shown in the embodiments of FIGS. 1 and 2, there is a retaining passage 340 separating each of the working surfaces. This allows the user the option of determining the orientation of the working surfaces.

It is understood that a retaining passage is an optional feature and that other locking mechanisms may be used, if desired. For example, the arm 215 may simply interact and engage with a working surface or other portion of the caddy cover to prevent rotation of the caddy cover.

The caddy cover 300 serves as a storage device for the lint roller 200. By keeping the caddy cover 300 over the roll of tape 220 of the lint roller 200 the tape does not become contaminated with dirt, dust, lint, and other debris that may be encountered during storage.

To use the brushing assembly 100, a user will place the caddy cover 300 over the barrel 225 and roll of tape 220 of a lint roller 200. Then, the user will slide a working surface over a surface to be cleaned to gather the debris. The user may use more than one of the working surfaces. Following gathering the debris, the user can remove the caddy cover 300 from the lint roller 200 and use the lint roller 200 to capture and retain the debris. It is understood that the brushing assembly 100 can be used for cleaning applications. However, the brushing assembly can also be used to brush hair such as brushing the coat of a pet.

Figure 3:
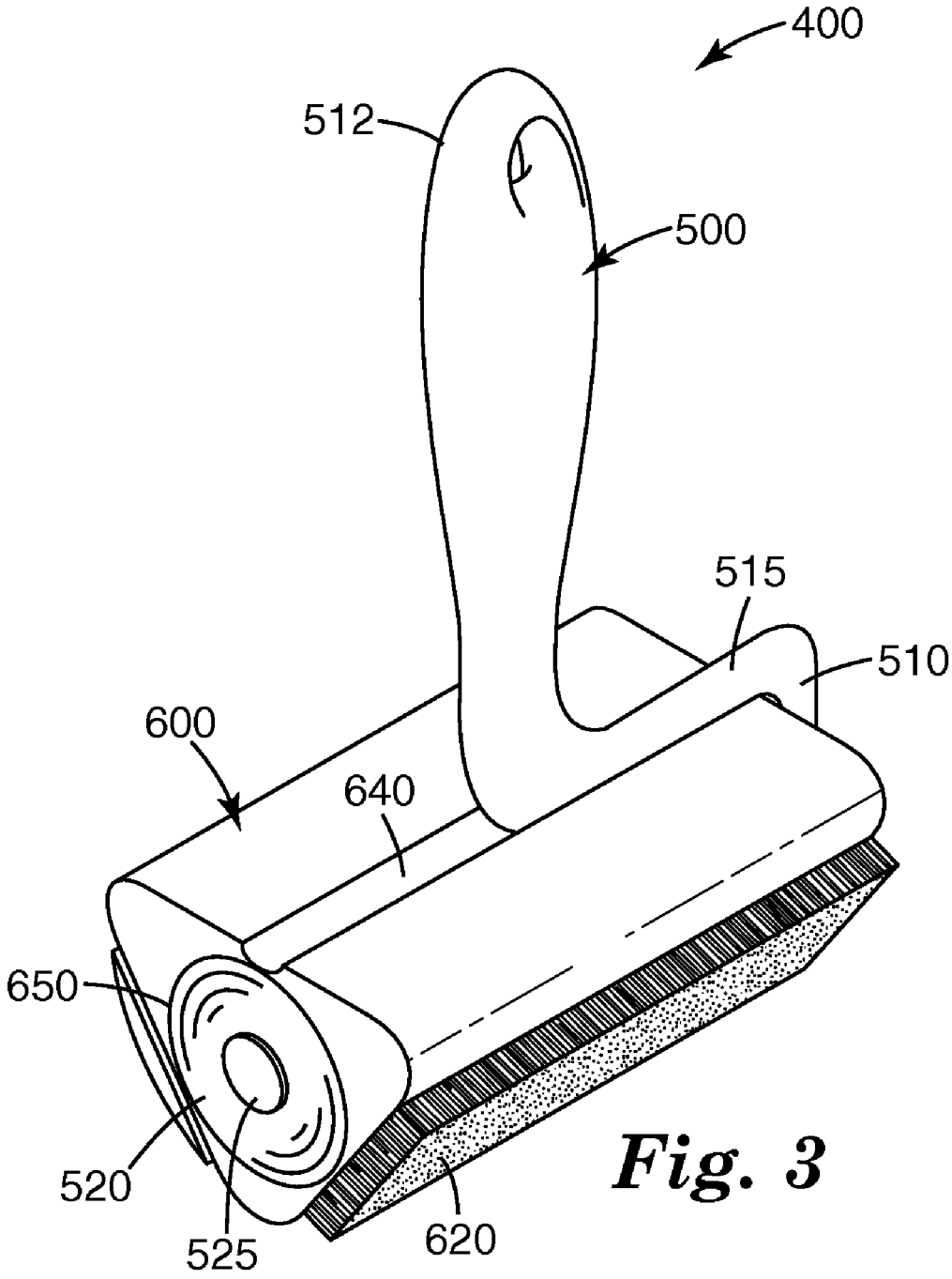
FIG. 3 is a perspective view of another embodiment of a brushing assembly having two working surfaces.

FIG. 3 is a perspective view of another embodiment of a brushing assembly 400. The brushing assembly 400 includes a lint roller 500 and a caddy cover 600 for placement over the lint roller 500. The caddy cover 600 can be removed from the lint roller 500 similar to that shown in FIG. 2.

The lint roller 500 includes a handle 510 and a roll of tape 520 (not shown), wherein the tape is rolled such that the adhesive is exposed. The roll of tape 520 is supported on a barrel 525 of the handle 510. The roll of tape 520 freely rotates about the barrel 525.

The handle 510 includes a gripping portion 512 intended to be held by a user's hand and an arm 515 connecting the gripping portion 512 to the barrel 525 of the lint roller 500. The lint roller 500 shown is referred to a flat surface roller, as described above. However, it is understood that a linear lint roller may be used.

The caddy cover 600 includes two working surfaces and an opening 650. The opening 650 is for placement over the barrel 525 and roll of tape 520 of the lint roller 500. In the embodiment shown in FIG. 3, the caddy cover 600 includes a first working surface 610 and a second working surface 620. The working surfaces may be planar or may be curved. In either case, the working surfaces extend along the direction of the barrel 525 of the lint roller 500. As shown, first and second working surfaces 610, 620 are planar.

The working surfaces may be constructed from a variety of material as described above. In one embodiment, at least one of the working surfaces includes a brushing surface.

To prevent the caddy cover 600 from rotating during use, a locking mechanism may be included. In one embodiment, the locking mechanism includes a retaining passage 640 on the caddy cover 600. The retaining passage 640 is recessed enough to allow the caddy cover 600 to be placed over the lint roller 500 and to have the arm 515 contact the retaining passage 640 to prevent rotation of the caddy cover 600. The arm 515 of the handle 510 of the lint roller 500 engages with the retaining passage 640 to prevent rotation of the caddy cover 600. As shown in the embodiment of FIG. 3, the retaining passage 640 separates the two working surfaces 610, 620.

It is understood that any combination of materials, such as those described above, may be chosen for covering the working surfaces. Also, it is understood that any number of working surfaces may be included on the caddy cover.

Although specific embodiments of this invention have been shown and described herein, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

What is claimed is:

1. A brushing assembly comprising:

a lint roller comprising a handle and a roll of adhesive tape supported by a barrel, wherein the adhesive tape has an exposed tacky surface;

a caddy cover comprising an opening for placement over the barrel and roll of adhesive tape of the lint roller and at least two working surfaces, wherein each of the working surfaces comprises a different material.

2. The brushing assembly of claim 1, wherein at least one of the working surfaces comprises a brushing surface.

3. The brushing assembly of claim 1, wherein the working surfaces are selected from the group consisting of bristles, foam, sponge, rubber-latex foam, adhesive tape, hook fasteners and microreplicated film.

4. The brushing assembly of claim 1, wherein the caddy cover comprises three working surfaces.

5. The brushing assembly of claim 1, wherein at least one of the working surfaces is planar and parallel to the barrel of the lint roller.

6. The brushing assembly of claim 1, wherein at least one of the working surfaces is curved and parallel to the barrel of the lint roller.

7. The brushing assembly of claim 1, further comprising at least one retaining passage on the caddy cover, wherein the retaining passage engages with the handle of the lint roller to lock and prevent rotation of the caddy cover.

8. The brushing assembly of claim 7, wherein the lint roller is a flat surface lint roller and a portion of the handle that extends parallel with the barrel engages with the retaining passage.

9. The brushing assembly of claim 1, wherein each working surface is separated by a retaining passage, wherein the retaining passage engages with the handle of the lint roller to lock and prevent rotation of the caddy cover.

10. A brushing assembly comprising:

a lint roller comprising a handle and a roll of adhesive tape supported by a barrel, wherein the adhesive tape has an exposed tacky surface;

a caddy cover comprising an opening for placement over the barrel and roll of adhesive tape of the lint roller and a first working surface, second working surface, and a third working surface, wherein each working surface extends along the direction of the barrel, the caddy cover further including a first retaining passage separating the first and second working surfaces, a second retaining passage separating the second and third working surface, and a third retaining passage separating the third and first working surfaces.

11. The brushing assembly of claim 10, wherein the working surfaces are selected from the group consisting of bristles, foam, sponge, rubber-latex foam, adhesive tape, hook fasteners and microreplicated film.

12. The brushing assembly of claim 10, wherein the first working surface comprises a first microreplicated film, the second working surface comprises a second microreplicated film, and the third working surface comprises a third microreplicated film.

13. The brushing assembly of claim 10, wherein the first retaining passage engages with the handle of the lint roller to lock and prevent rotation of the caddy cover.

14. The brushing assembly of claim 10, wherein each of the retaining passages selectively engages with the handle of the lint roller to lock and prevent rotation of the caddy cover.

15. A method of cleaning a surface comprising:

providing a lint roller including a handle, a barrel extending from the handle, and a roll of adhesive tape supported by the barrel;

providing a caddy cover separate from the lint roller and having at least one working surfaces;

placing the caddy cover over the lint roller;

manipulating the handle to brush the surface to be cleaned with at least one of the working surfaces of the caddy cover to gather debris;

removing the caddy cover from an entirety of the lint roller; and manipulating the handle to roll the lint roller over the surface to be cleaned to capture the debris.

16. The method of claim 15, further comprising locking the caddy cover with respect to the lint roller to prevent rotation of the caddy cover.

17. The method of claim 15, wherein the caddy cover includes at least two working surfaces and each of the working surfaces comprises a different material.

18. The method of claim 17, wherein the working surfaces are selected from the group consisting of bristles, foam, sponge, rubber-latex foam, adhesive tape, hook fasteners and microreplicated film.

19. The method of claim 15, wherein the lint roller is a flat surface roller having a barrel and a handle with a portion parallel to the barrel, wherein the portion of the handle parallel to the barrel engages with the caddy cover to lock and prevent rotation of the caddy cover.

* * * * *

UNITED STATES PATENT AND TRADEMARK OFFICE

CERTIFICATE OF CORRECTION

PATENT NO. : 7,856,690 B2
APPLICATION NO. : 11/562448
DATED : December 28, 2010
INVENTOR(S) : Scott J Tuman It is certified that error appears in the above-identified patent and that said Letters Patent is hereby corrected as shown below:

Column 3

Line 20; delete "20003-0171051-A1" and insert -- 2003-0171051-A1 --, therefor.

Column 6

Line 28; Claim 14, delete "engages" and insert -- engage --, therefor.

Signed and Sealed this
Fifth Day of April, 2011

David J. Kappos
*Director of the United States Patent and Trademark Office*